US012063959B2

(12) United States Patent
Capiti

(10) Patent No.: US 12,063,959 B2
(45) Date of Patent: Aug. 20, 2024

(54) HOOKAH ADAPTER ASSEMBLY

(71) Applicant: Michael Capiti, Oakland, CA (US)

(72) Inventor: Michael Capiti, Oakland, CA (US)

( * ) Notice: Subject to any disclaimer, the term of this patent is extended or adjusted under 35 U.S.C. 154(b) by 322 days.

(21) Appl. No.: 17/528,881

(22) Filed: Nov. 17, 2021

(65) Prior Publication Data

US 2023/0148659 A1 May 18, 2023

(51) Int. Cl.
*A24F 1/30* (2006.01)
*A24F 13/12* (2006.01)

(52) U.S. Cl.
CPC ..... *A24F 1/30* (2013.01); *A24F 13/12* (2013.01)

(58) Field of Classification Search
CPC ..... A24F 1/30
See application file for complete search history.

(56) References Cited

U.S. PATENT DOCUMENTS 2,124,221 A * 10/1935 Jacobs
2,762,375 A 9/1956 Fessler
3,394,710 A 7/1968 Ping-Chuan
3,410,281 A 11/1968 Ephron
D357,731 S 4/1995 Chih
8,905,038 B2 12/2014 Lotringer
10,251,419 B2 4/2019 Camitta
2015/0272214 A1* 10/2015 Giller ..... A24F 47/002
2021/0000170 A1* 1/2021 Jacobson ..... A24F 1/30
2021/0137157 A1* 5/2021 Dabaghy ..... A24F 1/30

FOREIGN PATENT DOCUMENTS

WO WO 2014/076597 A2 * 5/2014
WO WO2015062145 5/2015

* cited by examiner

*Primary Examiner* — Christopher M Rodd
*Assistant Examiner* — Daniel Edward Vakili

(57) ABSTRACT

A hookah adapter assembly for facilitating a cigarette to be smoked with a hookah includes a bowl that has a foraminous base and a tube extending through the foraminous base of the bowl which can be inserted into an intake of a hookah. A holder is attached to the tube and the holder is in fluid communication with the hookah when the tube is inserted into the intake of the hookah. The holder has a pair of intake ports each extending into an interior of the holder to insertably receive a cigarette thereby facilitating the cigarette to be smoked with the hookah. A pair of lids is each hingedly disposed on the holder for opening or closing the intake ports.

10 Claims, 11 Drawing Sheets

FIG. 7
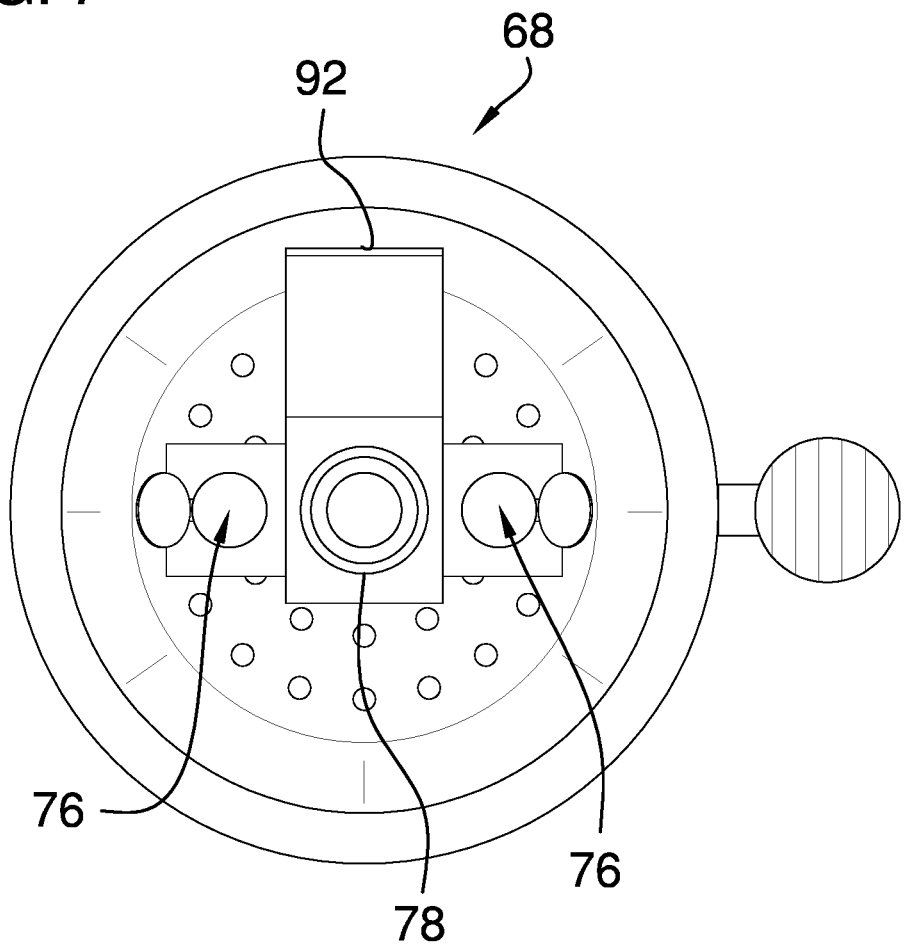
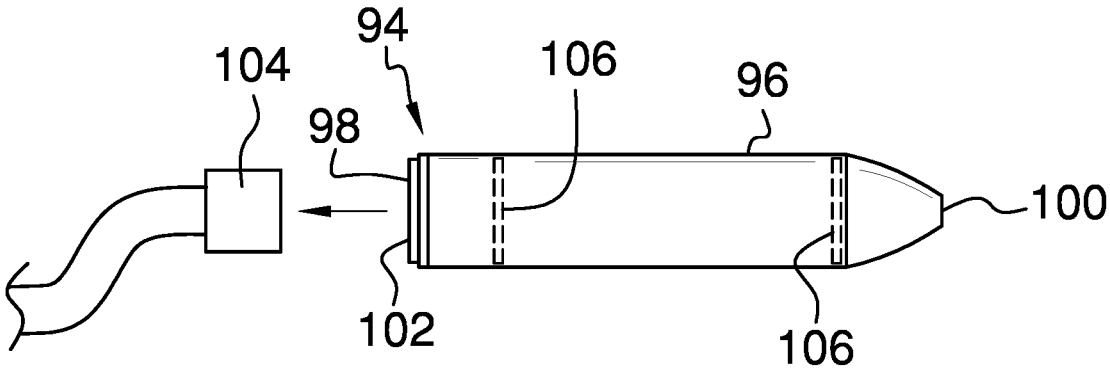
FIG. 8

HOOKAH ADAPTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYTUBE

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to adapter devices and more particularly pertains to a new adapter device for smoking a cigarette in a hookah. The device includes a bowl with a foraminous base and a tube extending through the foraminous base to engage an intake of the hookah. The device includes a holder that is insertable into the tube and the holder has a pair of intake ports. Each of the intake ports can insertably receive a cigarette to facilitate the cigarette in each intake port to be smoked with the hookah.

(2) Description of Related Art Including Information Disclosed Under 37 CFR 1.97 and 1.98

The prior art relates to adapter devices including a frustoconical holder for insertably holding a cigarette for smoking. The prior art discloses a variety of water filtered smoking pipes, each having an integral water reservoir, for smoking tobacco. The prior art discloses a portable hookah for smoking tobacco or cannabis. The prior art discloses a water pipe which has a sleeve shaped adapter for insertably receiving an electronic vaporizer pen. The prior art discloses a universal bowl and stem device for attaching to a variety of different styles of hookahs.

BRIEF SUMMARY OF THE INVENTION

An embodiment of the disclosure meets the needs presented above by generally comprising a bowl that has a foraminous base and a tube extending through the foraminous base of the bowl which can be inserted into an intake of a hookah. A holder is attached to the tube and the holder is in fluid communication with the hookah when the tube is inserted into the intake of the hookah. The holder has a pair of intake ports each extending into an interior of the holder to insertably receive a cigarette thereby facilitating the cigarette to be smoked with the hookah. A pair of lids is each hingedly disposed on the holder for opening or closing the intake ports.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 7 is a top view of an alternative embodiment of the disclosure.

FIG. 8 is a phantom perspective view of an alternative embodiment of the disclosure.

DETAILED DESCRIPTION OF THE INVENTION

Figure 1:
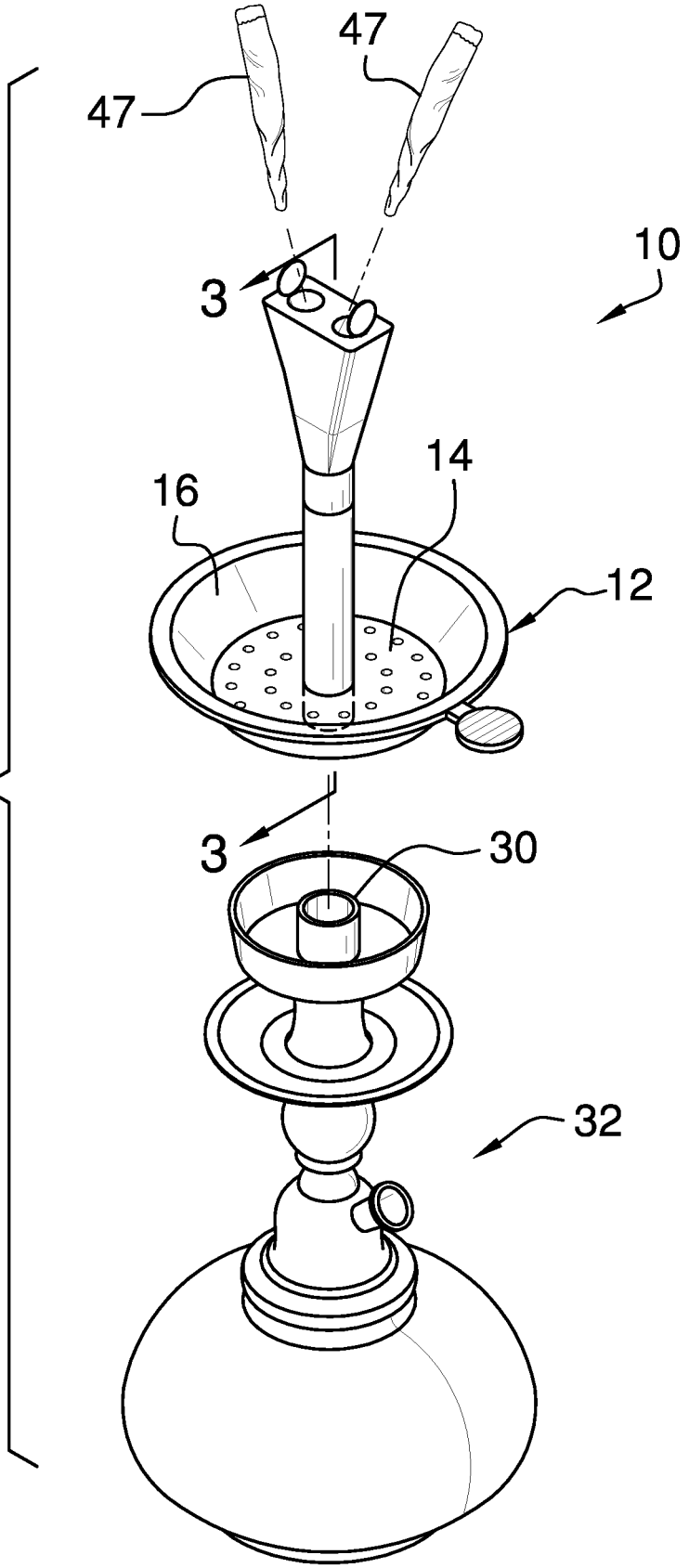
FIG. 1 is an exploded perspective view of a hookah adapter assembly according to an embodiment of the disclosure.
Figure 2:
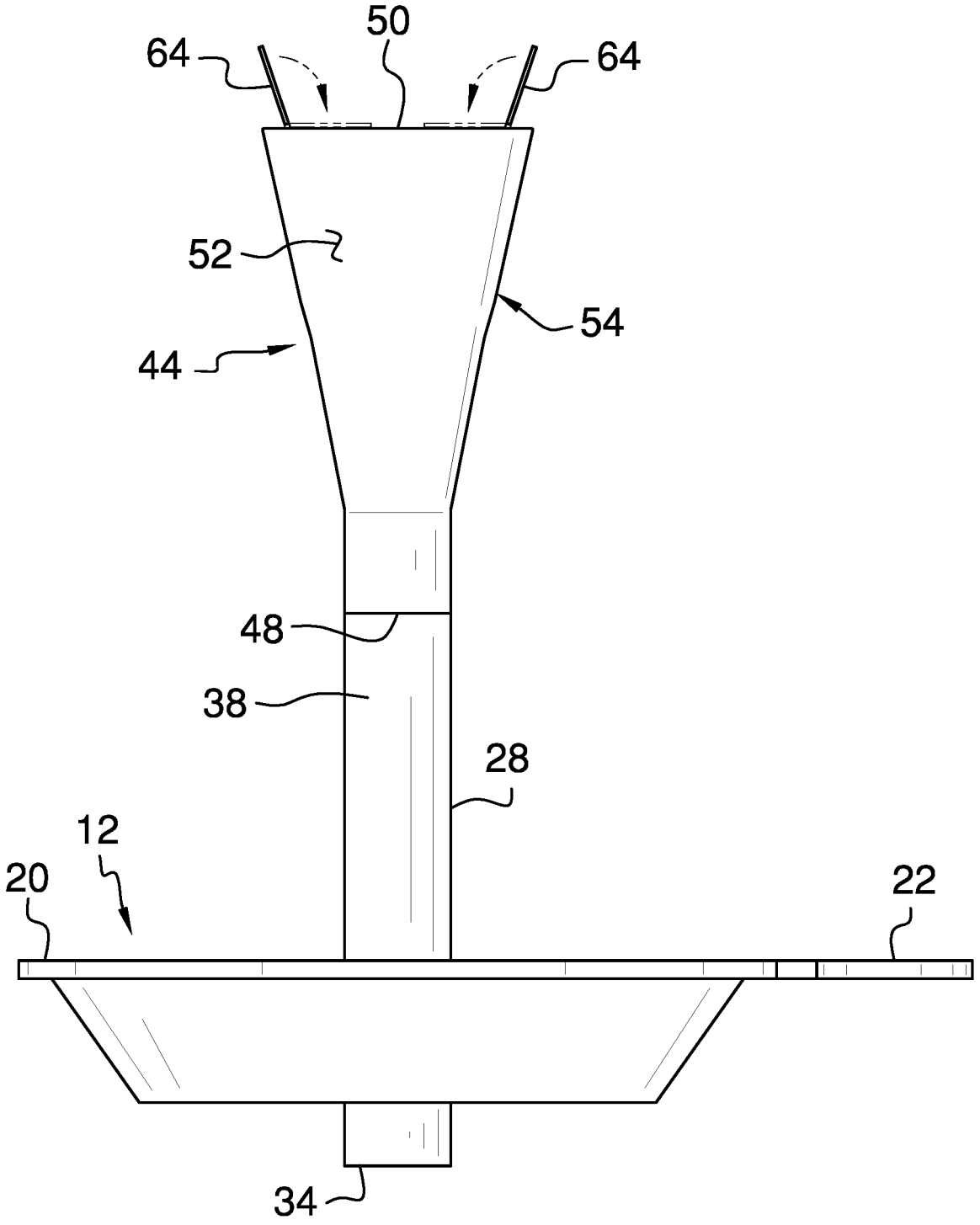
FIG. 2 is a front view of an embodiment of the disclosure.
Figure 3:
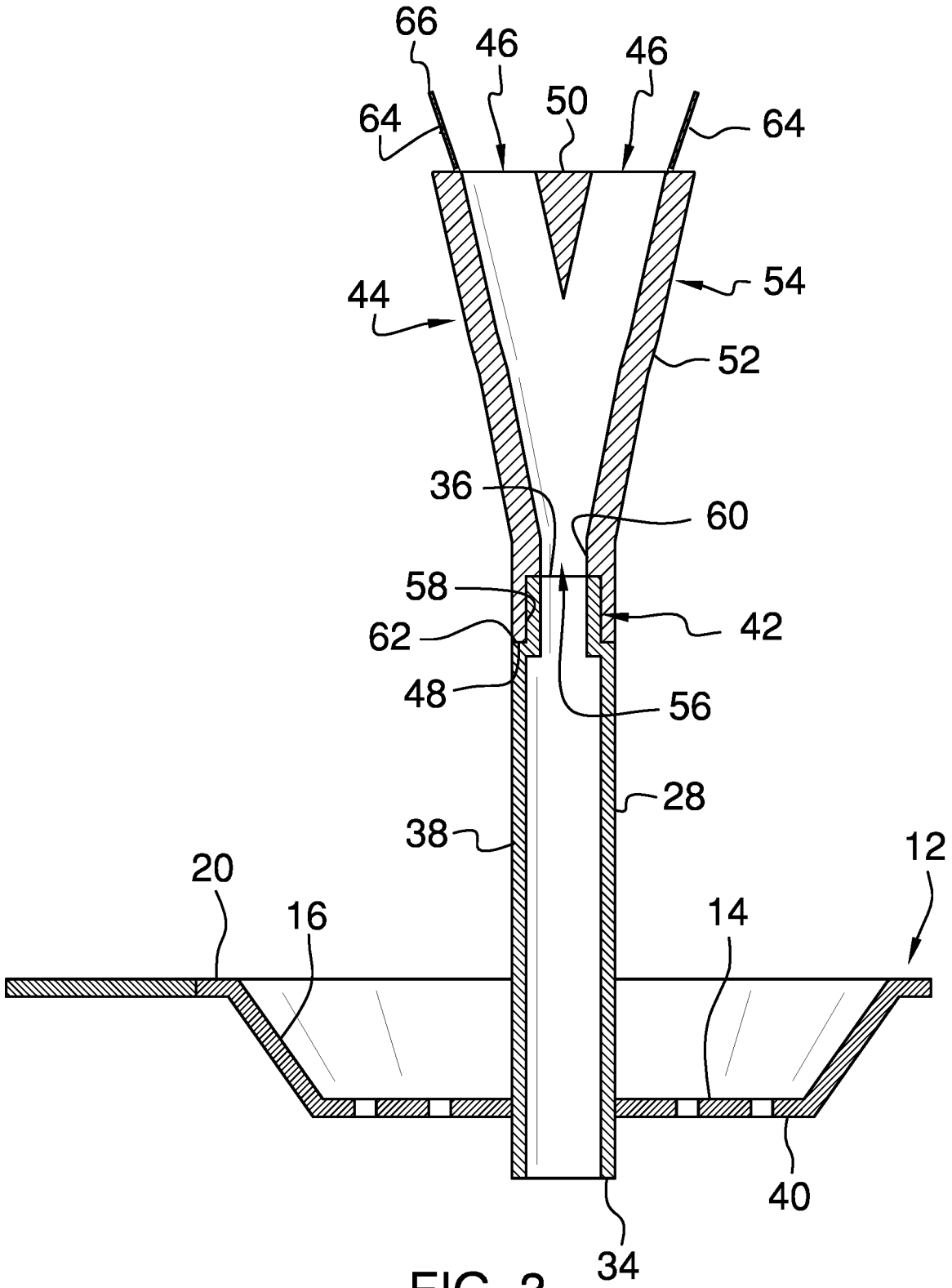
FIG. 3 is a cross sectional view taken along line 3-3 of FIG. 1 of an embodiment of the disclosure.
Figure 4:
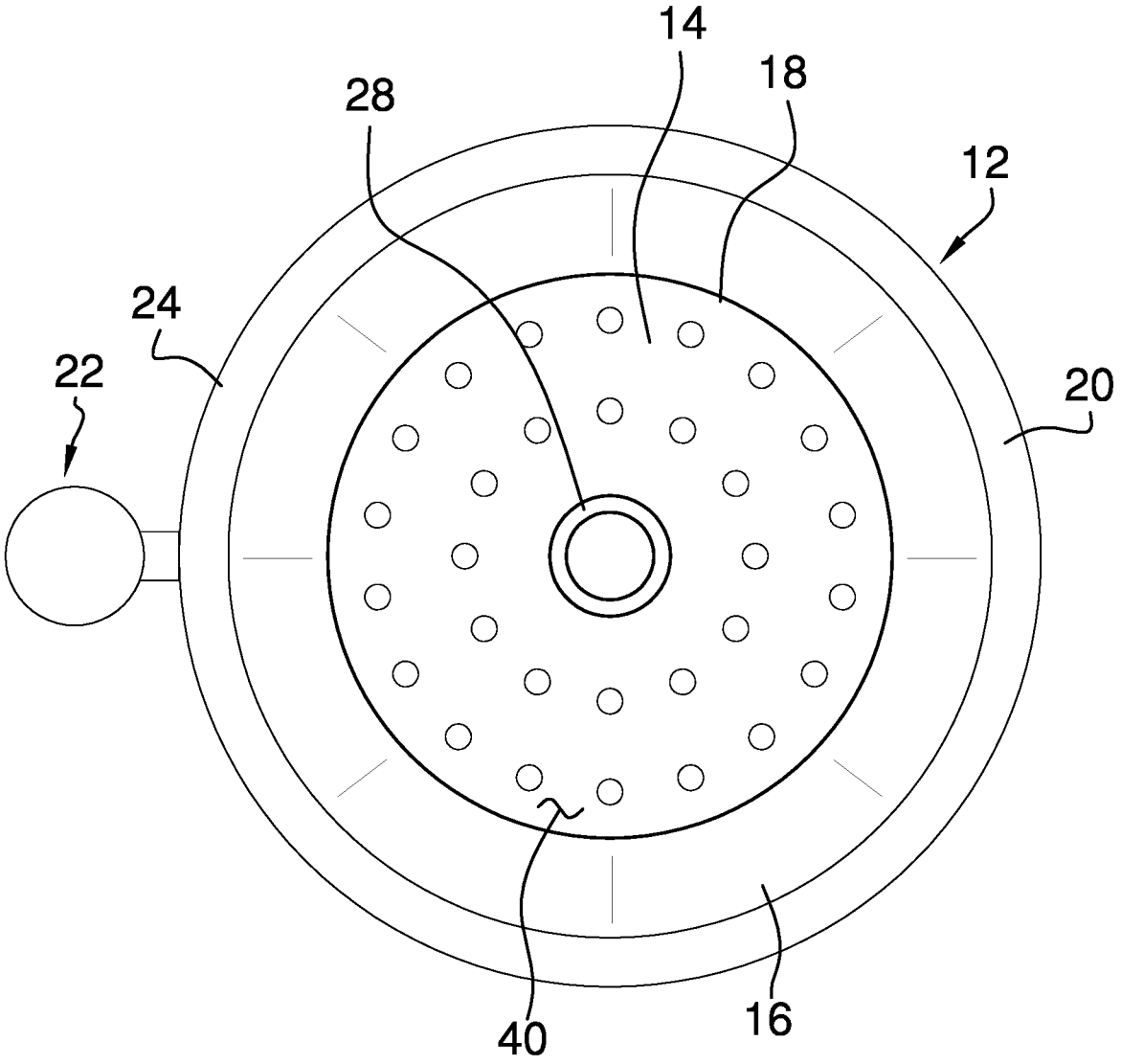
FIG. 4 is a bottom view of an embodiment of the disclosure.
Figure 5:
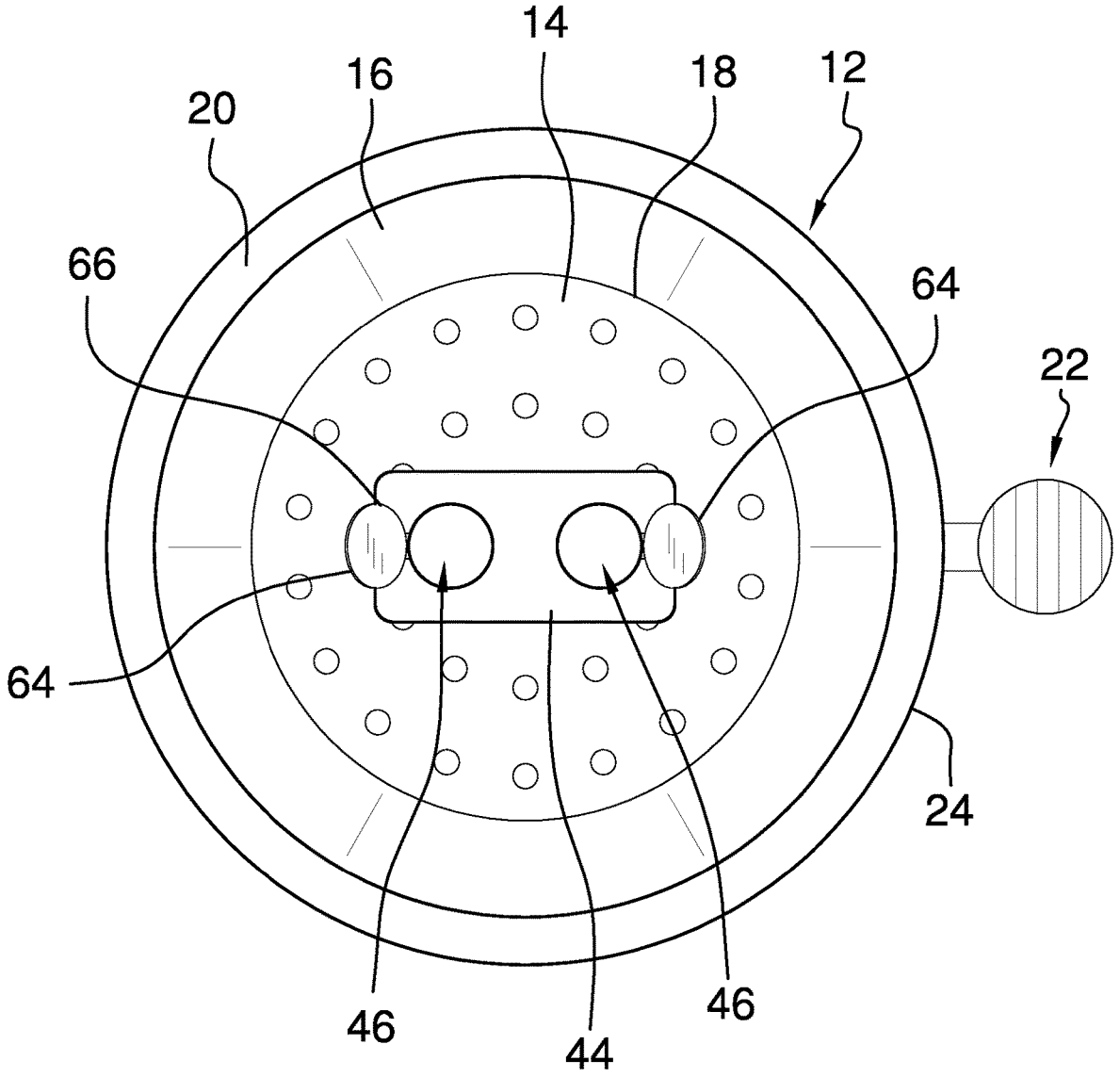
FIG. 5 is a top view of an embodiment of the disclosure.

With reference now to the drawings, and in particular to FIGS. 1 through 12 thereof, a new adapter device embodying the principles and concepts of an embodiment of the disclosure and generally designated by the reference numeral 10 will be described.

As best illustrated in FIGS. 1 through 12, the hookah adapter assembly 10 generally comprises a bowl 12 that has a foraminous base 14 to facilitate combustion of a burning charcoal placed on the foraminous base 14. The bowl 12 has an outer wall 16 extending upwardly from a perimeter 18 of the foraminous base 14 and the outer wall 16 angles outwardly from the foraminous base 14. The outer wall 16 has a lip 20 that is distally positioned with respect to the foraminous base 14 and the lip 20 has a handle 22 extending away from an outer edge 24 of the lip 20. Furthermore, the handle 22 is rounded at a distal end 26 of the handle 22 to facilitate the handle 22 to be gripped by a user.

A tube 28 is provided and the tube 28 extends through the foraminous base 14 of the bowl 12 such that the tube 28 can be inserted into an intake 30 of a hookah 32. The tube 28 has a bottom end 34, a top end 36 and an outer wall 38 extending between the bottom end 34 and the top end 36. The bottom end 34 is spaced from a bottom surface 40 of the foraminous base 14 having the tube 28 being perpendicularly oriented with the foraminous base 14. The tube 28 is centrally positioned on the foraminous base 14 and the outer wall 16 has a recessed portion 42 extending downwardly from the top end 36.

A holder 44 is attached to the tube 28 such that the holder 44 is in fluid communication with the hookah 32 when the tube 28 is inserted into the intake 30 of the hookah 32. The holder 44 has a pair of intake ports 46 each extending into an interior of the holder 44 to facilitate air to be drawn through the intake ports 46 and into the hookah 32. Each of the intake ports 46 is rounded to insertably receive a cigarette 47 thereby facilitating the cigarette 47 to be smoked with the hookah 32. The cigarette 47 may be a tobacco cigarette, a cannabis cigarette or any other type of cigarette that would commonly be smoked for pleasure. The holder 44 has a lower end 48, an upper end 50 and an outer surface 52 extending between the lower end 48 and the upper end 50, and the holder 44 is elongated between the upper end 50 and the lower end 48.

The outer surface 52 flares outwardly between the lower end 48 and the upper end 50 to define a flared portion 54 of the holder 44 adjacent to the upper end 50 such that the holder 44 has a Y-shape. Each of the intake ports 46 is positioned on the upper end 50 and the intake ports 46 are spaced apart from each other on the upper end 50. The holder 44 has a hole 56 extending through the lower end 48 and intersecting each of the intake ports 46. Additionally, the hole 56 has a first portion 58 that has a diameter which is greater than a second portion 60. The first portion 58 extends between the lower end 48 of the holder 44 and the second portion 60, and the second portion 60 extends between the first portion 58 and each of the intake ports 46. The first portion 58 insertably receives the top end 36 of the tube 28 having the lower end 48 of the holder 44 resting on a threshold 62 of the recessed portion 42 of the outer wall 16 of the tube 28.

A pair of lids 64 is provided and each of the lids 64 is hingedly disposed on the holder 44. Each of the lids 64 is aligned with a respective one of the intake ports 46 for opening 84 or closing the intake ports 46. Each of the lids 64 has an exterior edge 66 that is continuously arcuate such that each of the lids 64 has a disk shape. Furthermore, the exterior edge 66 of each of the lids 64 is hingedly coupled to the upper end 50 of the holder 44.

Figure 6:
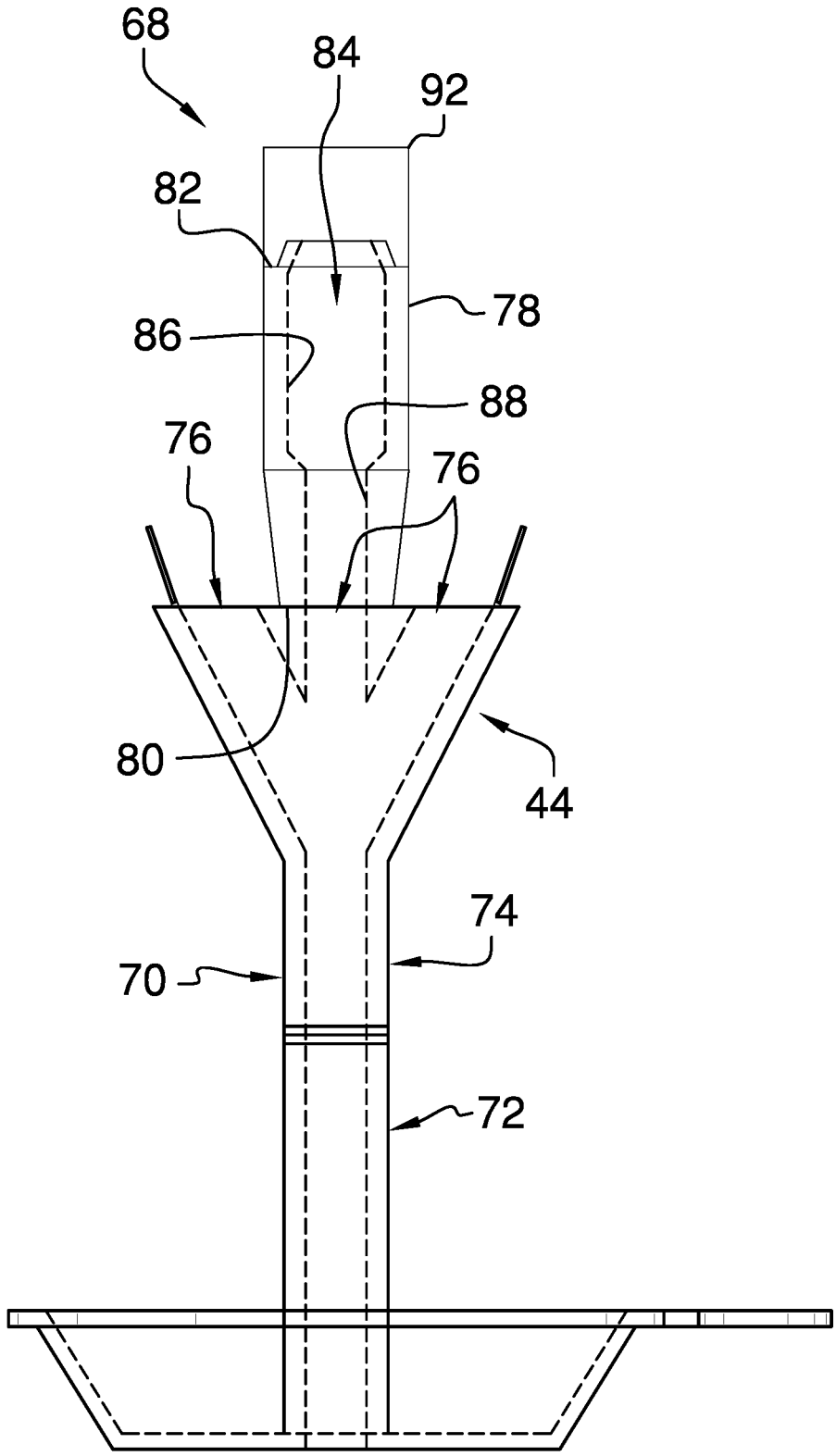
FIG. 6 is a front phantom view of an alternative embodiment of the disclosure.

In an alternative embodiment 68 as is most clearly shown in FIGS. 6 and 7, the holder 44 has an elongate portion 70 which extends between the lower end 48 and the flared portion 54. The elongate portion 70 comprises a first section 72 that is removably matable to a second section 74. The first section 72 is associated with the lower end 48 and the second section 74 is associated with the flared portion 54. The holder 44 has a plurality of the intake ports 76 each extending through the upper end 50.

Continuing in the alternative embodiment 68, a retainer 78 is provided which has a lowermost end 80 and an uppermost end 82. The retainer 78 has an opening 84 extending through the lowermost end 80 and the uppermost end 82, and the opening 84 has a topmost portion 86 and a lowermost portion 88. The topmost portion 86 has a diameter that is greater than a diameter of the lowermost portion 88. Moreover, the lowermost end 80 engages a respective one of the intake ports 46 in the upper end 50 of the holder 44 such that the uppermost end 82 can insertably receive an electronic vaporizer pen thereby facilitating the vaporizer pen to be smoked with the hookah 32. A cap 92 is hingedly disposed on the uppermost end 82 of the retainer 78. The cap 92 is positionable in a closed position having the cap 92 covering the opening 84 and the cap 92 is positionable in an open position having the cap 92 being displaced from the opening 84.

In an alternative embodiment 94 as is most clearly shown in FIG. 8, a mouthpiece 96 is provided that has a primary end 98 and a secondary end 100. Each of the primary end 98 and the secondary end 100 is open and the mouthpiece 96 is substantially hollow. The mouthpiece 96 tapers to a blunt point at the secondary end 100 and a coupler 102 is integrated into the primary end 98. The coupler 102 engages a smoking hose 104 of the hookah 32 thereby facilitating a user to inhale through the mouthpiece 96 for smoking the hookah 32. Additionally, a pair of filters 106 is each disposed within the mouthpiece 96 and each of the filters 106 is comprised of an air permeable material to filter particles from air which passes through the mouthpiece 96.

Figure 9:
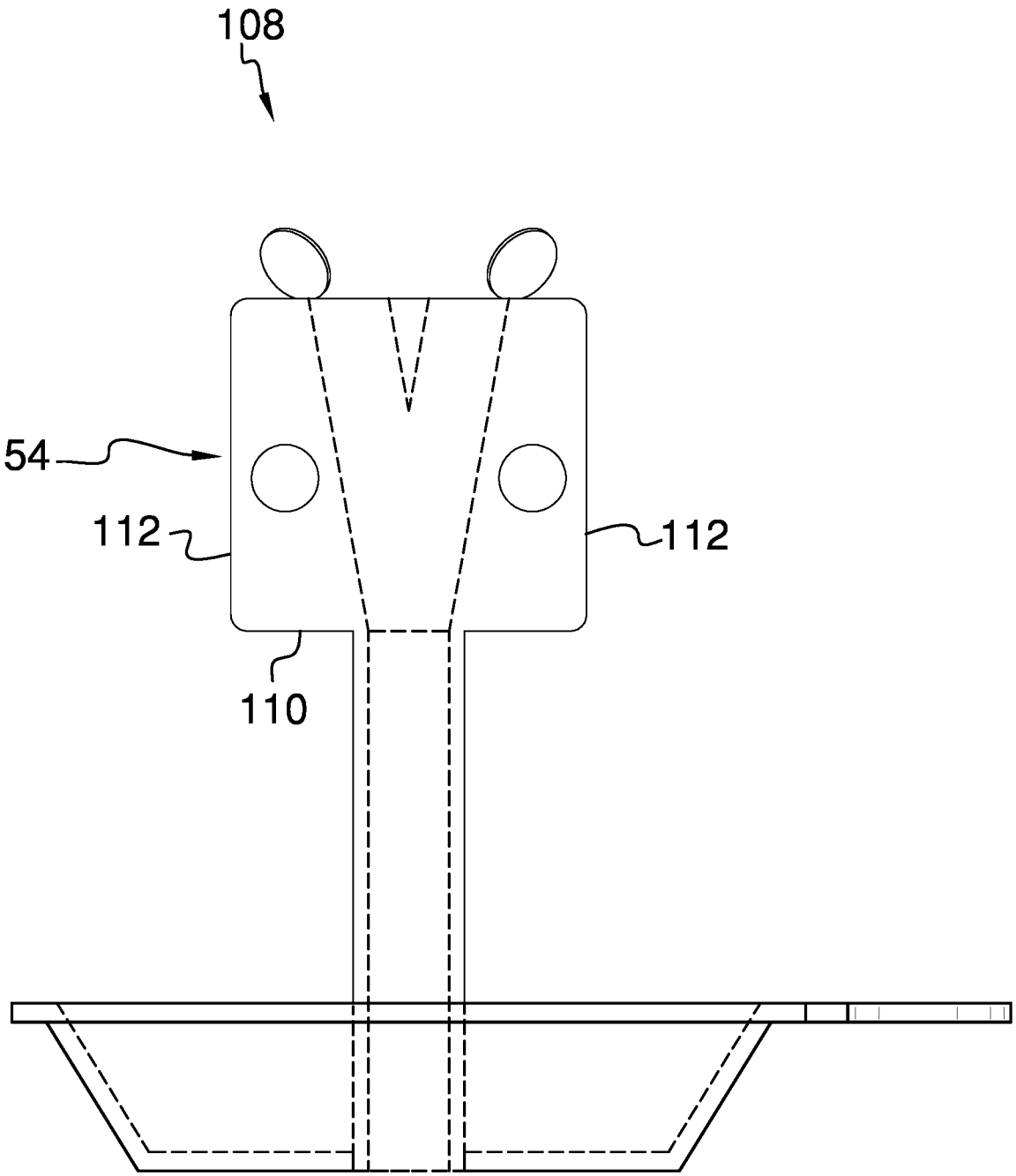
FIG. 9 is a phantom view of an alternative embodiment of the disclosure.
Figure 10:
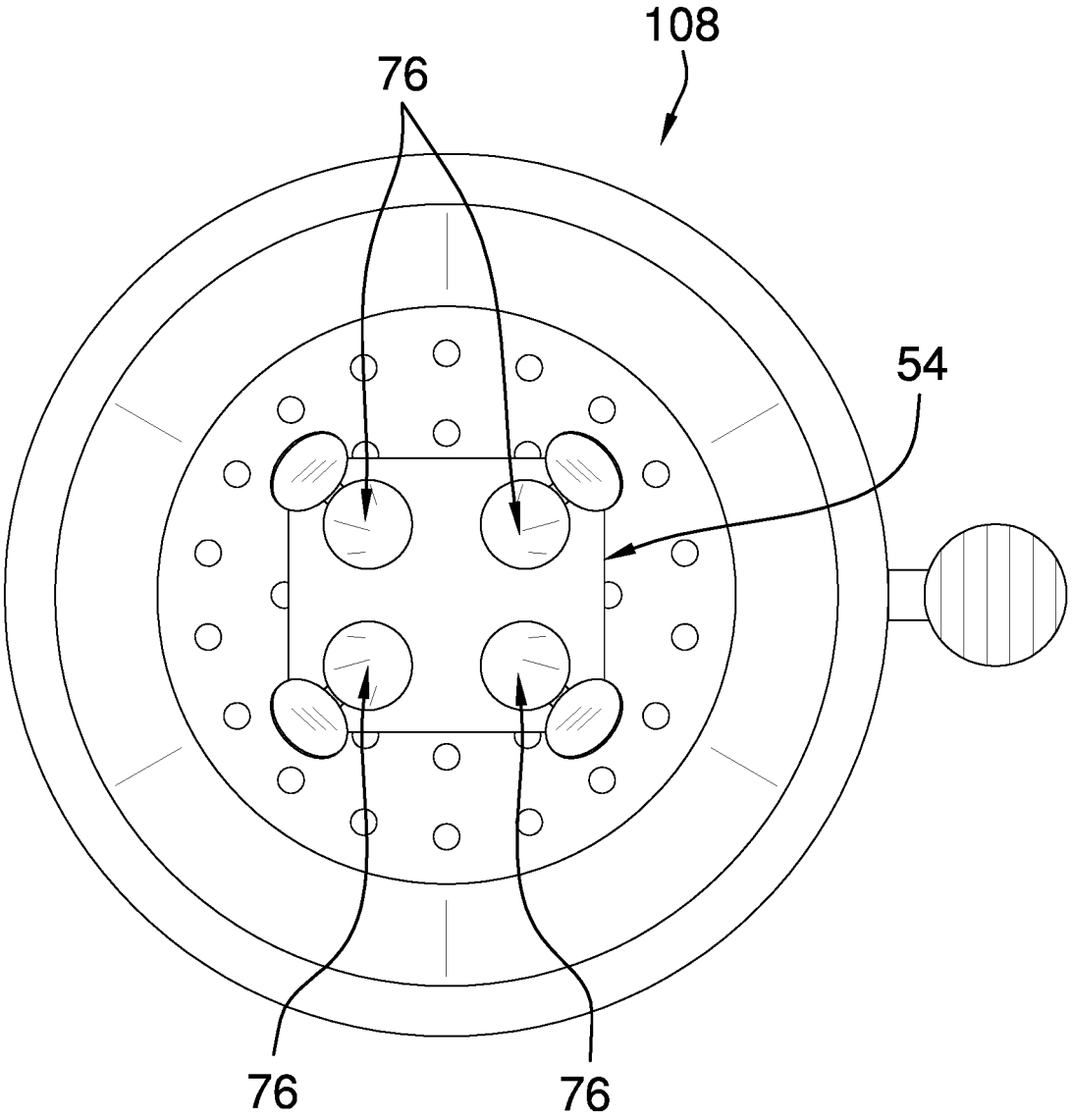
FIG. 10 is a top view of an alternative embodiment of the disclosure.
Figure 11:
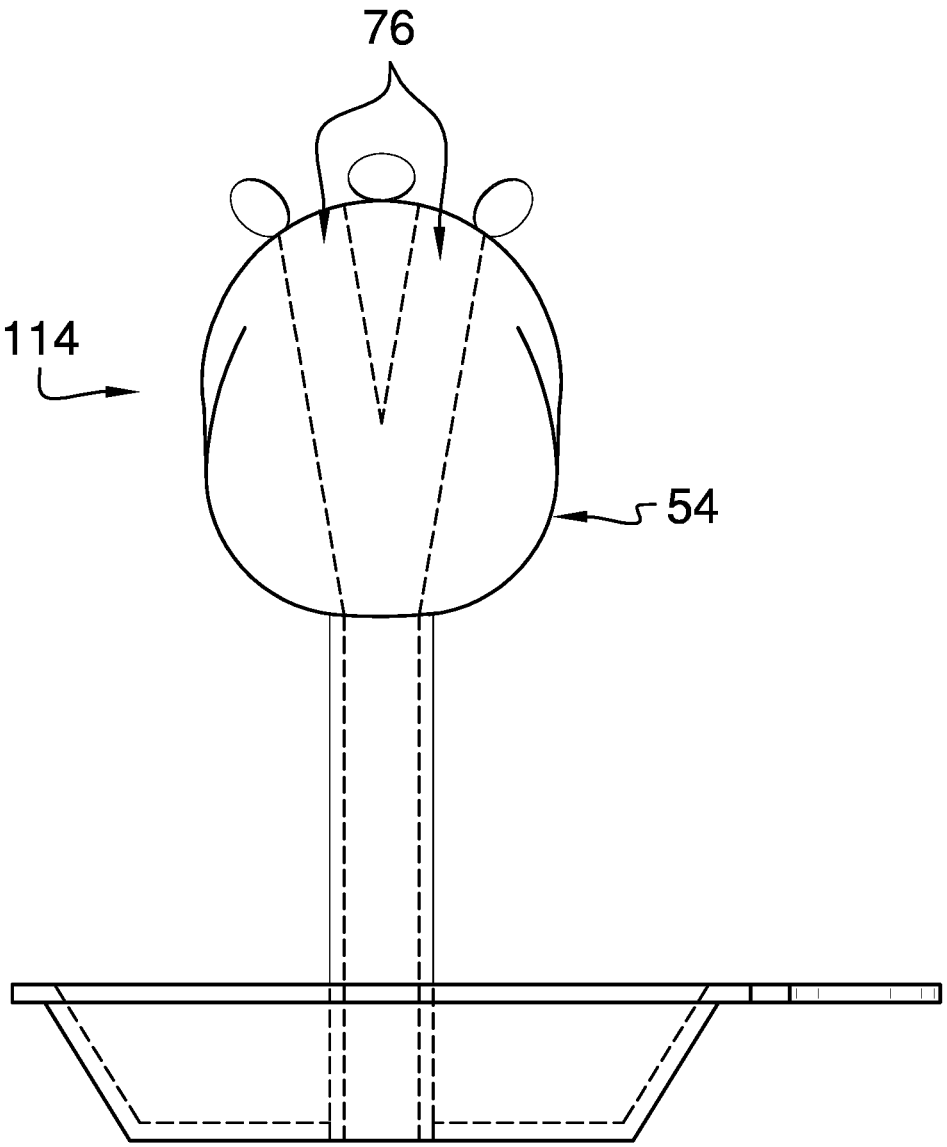
FIG. 11 is a back phantom view of an alternative embodiment of the disclosure.
Figure 12:
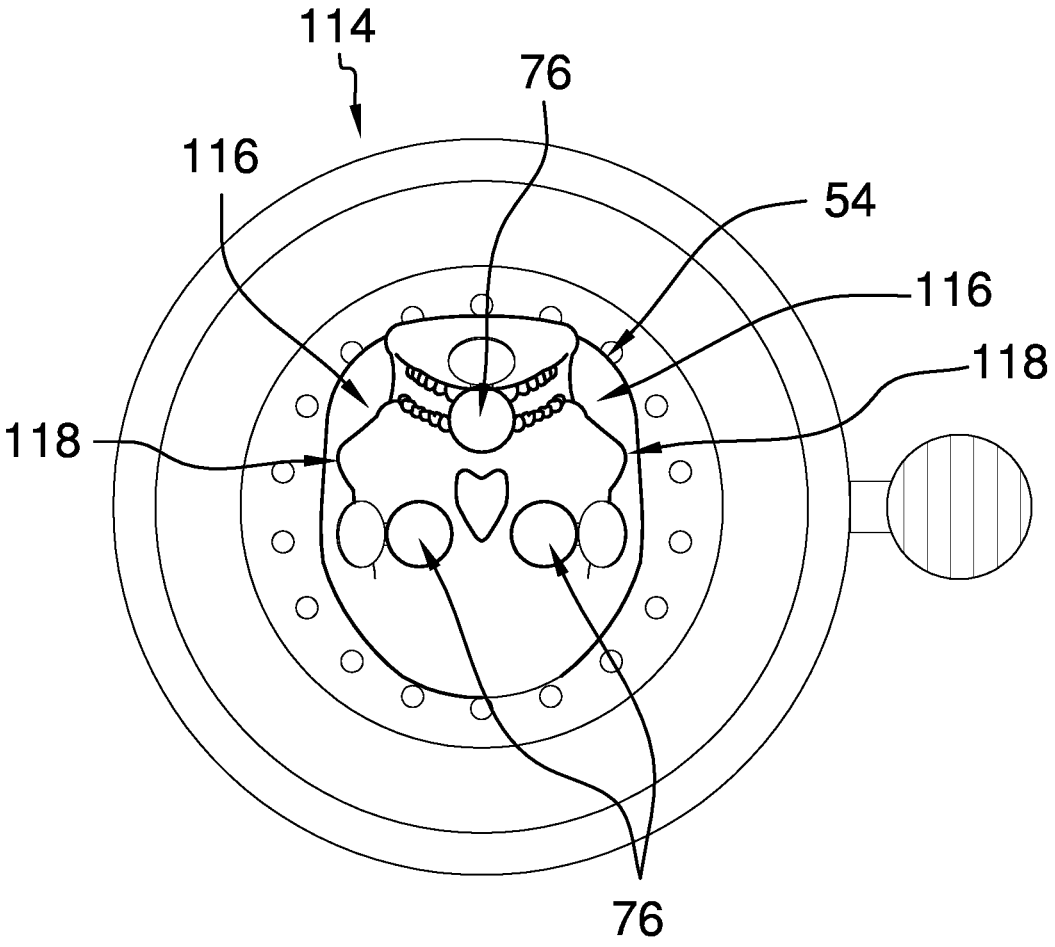
FIG. 12 is a top view of an alternative embodiment of the disclosure.

In an alternative embodiment 108 as is most clearly shown in FIGS. 9 and 10, the flared portion 54 of the holder 44 has a lower surface 110 that is oriented perpendicular to a pair of outward surfaces 112 extending between the lower surface 110 and the uppermost end 82 of the holder 44 such that the flared portion 54 has a rectangular shape. In an alternative embodiment 114 as is most clearly shown in FIGS. 11 and 12, the flared portion 54 is generally convexly arcuate. The flared portion 54 has a plurality of depressions 116 and prominences 118 each being strategically positioned such that the flared portion 54 has the ornamental appearance of a human skull.

In use, the bowl 12 is positioned on the intake 30 of the hookah 32 such that the bottom end 34 of the tube 28 is inserted into the intake 30. The lower end 48 of the holder 44 is engaged on the top end 36 of the tube 28 such that the holder 44 extends upwardly out of the bowl 12. In this way one or two cigarettes 48, depending on the user's preference, can be inserted into the intake ports 46 in the holder 44. Thus, the one or two cigarettes 48 can be smoked with the hookah 32 to facilitate a milder flavor for the user to enjoy.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hookah adapter assembly for facilitating a pair of cigarettes to be smoked with a hookah, said assembly comprising:

a bowl having a foraminous base wherein said foraminous base is configured to facilitate combustion of a burning charcoal placed on said foraminous base, said bowl having an upper most edge;

a tube extending through said foraminous base of said bowl wherein said tube is configured to be inserted into an intake of a hookah, said tube having a bottom end, a top end and an outer wall extending between said bottom end and said top end, said top end being positioned spaced above said uppermost edge of said bowl;

a holder being attached to said top end of said tube wherein said holder is configured to be in fluid communication with the hookah when said tube is inserted into the intake of the hookah, said holder having a pair of intake ports each extending into an interior of said holder wherein each of said intake ports is configured to facilitate air to be drawn through said intake ports and into the hookah, each of said intake ports being rounded wherein each of said intake ports is configured to insertably receive a cigarette thereby facilitating the cigarette to be smoked with the hookah; and a pair of lids, each of said lids being hingedly disposed on said holder, each of said lids being aligned with a respective one of said intake ports for opening or closing said intake ports.

2. The assembly according to claim 1, wherein said bowl has an outer wall extending upwardly from a perimeter of said foraminous base, said outer wall angling outwardly from said foraminous base, said outer wall having a lip being distally positioned with respect to said foraminous base, said lip having a handle extending away from an outer edge of said lip, said handle being rounded at a distal end of said handle wherein said handle is configured to be gripped by a user.

3. The assembly according to claim 2, wherein said tube has the bottom end, the top end and the outer wall extending between said bottom end and said top end, said bottom end being spaced from a bottom surface of said foraminous base having said tube being perpendicularly oriented with said foraminous base, said tube being centrally positioned on said foraminous base, said outer wall having a recessed portion extending downwardly from said top end.

4. The assembly according to claim 3, wherein said holder has a lower end, an upper end and an outer surface extending between said lower end and said upper end, said holder being elongated between said upper end and said lower end, said outer surface flaring outwardly between said lower end and said upper end such that said holder has a Y-shape, each of said intake ports being positioned on said upper end, said intake ports being spaced apart from each other on said upper end.

5. The assembly according to claim 4, wherein:

said holder has a hole extending through said lower end and intersecting each of said intake ports; and said hole has a first portion having a diameter being greater than a second portion, said first portion extending between said lower end of said holder and said second portion, said second portion extending between said first portion and each of said intake ports, said first portion insertably receiving said top end of said tube having said lower end of said holder resting on a threshold of said recessed portion of said outer wall of said tube.

6. The assembly according to claim 4, wherein each of said lids has an exterior edge being continuously arcuate such that each of said lids has a disk shape, said exterior edge of each of said lids being hingedly coupled to said upper end of said holder.

7. A hookah adapter assembly for facilitating a pair of cigarettes to be smoked with a hookah, said assembly comprising:

a bowl having a foraminous base wherein said foraminous base is configured to facilitate combustion of a burning charcoal placed on said foraminous base, said bowl having an outer wall extending upwardly from a perimeter of said foraminous base such that said bowl has an uppermost edge, said outer wall angling outwardly from said foraminous base, said outer wall having a lip being distally positioned with respect to said foraminous base, said lip having a handle extending away from an outer edge of said lip, said handle being rounded at a distal end of said handle wherein said handle is configured to be gripped by a user;

a tube extending through said foraminous base of said bowl wherein said tube is configured to be inserted into an intake of a hookah, said tube having a bottom end, a top end and an outer wall extending between said bottom end and said top end, said top end being positioned spaced above said uppermost edge of said bowl, said bottom end being spaced from a bottom surface of said foraminous base having said tube being perpendicularly oriented with said foraminous base, said tube being centrally positioned on said foraminous base, said outer wall having a recessed portion extending downwardly from said top end;

a holder being attached to said top end of said tube wherein said holder is configured to be in fluid communication with the hookah when said tube is inserted into the intake of the hookah, said holder having a pair of intake ports each extending into an interior of said holder wherein each of said intake ports is configured to facilitate air to be drawn through said intake ports and into the hookah, each of said intake ports being rounded wherein each of said intake ports is configured to insertably receive a cigarette thereby facilitating the cigarette to be smoked with the hookah, said holder having a lower end, an upper end and an outer surface extending between said lower end and said upper end, said holder being elongated between said upper end and said lower end, said outer surface flaring outwardly between said lower end and said upper end to define a flared portion of said holder adjacent to said upper end such that said holder has a Y-shape, each of said intake ports being positioned on said upper end, said intake ports being spaced apart from each other on said upper end, said holder having a hole extending through said lower end and intersecting each of said intake ports, said hole having a first portion having a diameter being greater than a second portion, said first portion extending between said lower end of said holder and said second portion, said second portion extending between said first portion and each of said intake ports, said first portion insertably receiving said top end of said tube having said lower end of said holder resting on a threshold of said recessed portion of said outer wall of said tube; and a pair of lids, each of said lids being hingedly disposed on said holder, each of said lids being aligned with a respective one of said intake ports for opening or closing said intake ports, each of said lids having an exterior edge being continuously arcuate such that each of said lids has a disk shape, said exterior edge of each of said lids being hingedly coupled to said upper end of said holder.

8. The assembly according to claim 7, wherein:

said holder has an elongate portion extending between said lower end and said flared portion, said elongate portion comprising a first section being removably matable to a second section, said first section being associated with said lower end, said second section being associated with said flared portion;

said holder has a plurality of said intake ports each extending through said upper end;

said assembly includes a retainer having a lowermost end and an uppermost end, said retainer having an opening extending through said lowermost end and said uppermost end, said opening having a topmost portion and a lowermost portion, said topmost portion having a diameter being greater than a diameter of said lowermost portion, said lowermost end engaging a respective one of said intake ports in said upper end of said holder wherein said uppermost end is configured to insertably receive an electronic vaporizer pen thereby facilitating the vaporizer pen to be smoked with the hookah; and a cap being hingedly disposed on said uppermost end of said retainer, said cap being positionable in a closed position having said cap covering said opening, said cap being positionable in an open position having said cap being displaced from said opening.

9. The assembly according to claim 7, wherein said flared portion of said holder has a lower surface being oriented perpendicular to a pair of outward surfaces extending between said lower surface and said uppermost end of said holder such that said flared portion has a rectangular shape.

10. The assembly according to claim 7, wherein said flared portion is generally convexly arcuate, said flared portion having an plurality of depressions and prominences each being strategically positioned such that said flared portion has the ornamental appearance of a human skull.

* * * * *